US008979153B2

(12) United States Patent
Scribner

(10) Patent No.: US 8,979,153 B2
(45) Date of Patent: Mar. 17, 2015

(54) WATER BOTTLE STRAP CARRIER

(71) Applicant: Sonya Anne Scribner, San Diego, CA (US)

(72) Inventor: Sonya Anne Scribner, San Diego, CA (US)

( * ) Notice: Subject to any disclaimer, the term of this patent is extended or adjusted under 35 U.S.C. 154(b) by 0 days.

(21) Appl. No.: 14/258,942

(22) Filed: Apr. 22, 2014

(65) Prior Publication Data

US 2014/0312082 A1 Oct. 23, 2014

Related U.S. Application Data

(60) Provisional application No. 61/814,406, filed on Apr. 22, 2013, provisional application No. 61/868,165, filed on Aug. 21, 2013.

(51) Int. Cl.
*A45F 5/10* (2006.01)
*A45C 13/30* (2006.01)
*A45F 5/00* (2006.01)

(52) U.S. Cl.
CPC . *A45C 13/30* (2013.01); *A45F 5/00* (2013.01); *A45C 2200/20* (2013.01); *A45F 2200/0583* (2013.01)
USPC ..... 294/157; 294/150; 294/152; 224/148.6

(58) Field of Classification Search
USPC ..... 294/137, 150, 152, 157, 74, 77; 248/311.2; 224/148.6, 148.7, 250, 674; D3/202, 229
See application file for complete search history.

(56) References Cited

U.S. PATENT DOCUMENTS

| | | | | | |
|---|---|---|---|---|---|
| 1,208,728 | A | * | 12/1916 | Barlett et al. | 224/148.6 |
| 1,677,583 | A | * | 7/1928 | Cromwell, Jr. | 383/20 |
| 3,820,695 | A | * | 6/1974 | Pecjak | 294/157 |
| 5,147,079 | A | * | 9/1992 | Heather | 294/157 |
| 5,174,481 | A | * | 12/1992 | LeDune | 224/250 |
| 5,622,346 | A | * | 4/1997 | Story, Jr. | 224/148.6 |
| 5,641,189 | A | * | 6/1997 | Landman | 294/77 |
| D419,392 | S | * | 1/2000 | Schlebusch | D7/619.1 |
| D447,862 | S | * | 9/2001 | Vagelatos et al. | D3/202 |
| 7,131,679 | B1 | * | 11/2006 | Teran | 294/151 |
| 2005/0092788 | A1 | * | 5/2005 | Jenkins | 224/148.6 |

* cited by examiner

*Primary Examiner* — Paul T Chin

(57) ABSTRACT

A water bottle strap carrier that includes a longitudinal strap, an upper latitudinal strap, and a lower latitudinal strap allows the users to easily grip and pickup a five gallon water bottle. The longitudinal strap restricts the vertical movement of the water bottle while the upper and lower latitudinal straps restricts the horizontal movement of the water bottle. A first and a second handle of the longitudinal strap are positioned above the water bottle providing griping areas for the users, and the rest of the water bottle strap carrier is positioned below the first and second handle as a harness around the water bottle.

18 Claims, 11 Drawing Sheets

WATER BOTTLE STRAP CARRIER

The current application claims a priority to the U.S. Provisional Patent application Ser. No. 61/814,406 filed on Apr. 22, 2013 and the U.S. Provisional Patent application Ser. No. 61/868,165 filed on Aug. 21, 2013.

FIELD OF THE INVENTION

The present invention relates generally to an apparatus for a bottle strap carrier. More specifically the present invention relates to a harness with handles designed to carry items including, but not limited to, five gallon water bottles.

BACKGROUND OF THE INVENTION

Drinking water is commonly delivered to homes and offices in five gallon carboy type bottles. Because of the large carrying capacity of theses bottles, they can become very heavy and difficult to carry when filled. In order to ease this burden, an assisting carrying device can be used to make the transportation of these bottles less troublesome. Numerous attempts to develop a solution have been made in the past. For example, an existing harness involves a strap that is attached to itself around the top of the bottle and two handles that are attached to the strap. The two handles are used for carrying the bottle and stick up above the top of the bottle. In an alternative embodiment of the existing harness, the two handles are narrowed down into a single handle. The major issue with both of these existing harnesses is their lack of security. These harnesses attach to the bottle in only one location, near the top of the bottle. When bottle is fully filled, these bottles can become very heavy and it would be preferred for the harnesses to have additional support points. Another existing harness provides a structure that can attach around the top of the bottle as well as the bottom of the bottle. Several straps are attached below the bottle to provide additional support to the bottom of the container. The structure is also completed with two handles, where the two handles are very short in comparison to the rest of the structure. The length of these handles may present a problem as the handles would not reach above the tops of larger containers. This would make carrying a container by the handles very difficult and awkward.

All of the existing apparatuses have still yet to address all the relevant issues, with the most notable of these issues being the convenient placement of the handles and the ability to fully secure the bottle. Therefore, it is the object of the present invention to allow the average person to carry objects, including a five gallon water bottle, with more ease, comfort, and security while transporting the objects to their cars, homes, and offices. The present invention utilizes a pair of handles on a basket, for an object to be transported more comfortably. The basket minimizes the possibility of the bottle being dropped during transport. As a result the possibility of a person being injured due to an object dropping and shattering is substantially reduced. The present invention is fabricated from heavyweight polypropylene, has UV protection, and does not absorb water quickly providing a better resistance against mildew and rot.

DETAIL DESCRIPTIONS OF THE INVENTION

All illustrations of the drawings are for the purpose of describing selected versions of the present invention and are not intended to limit the scope of the present invention.

Figure 1:
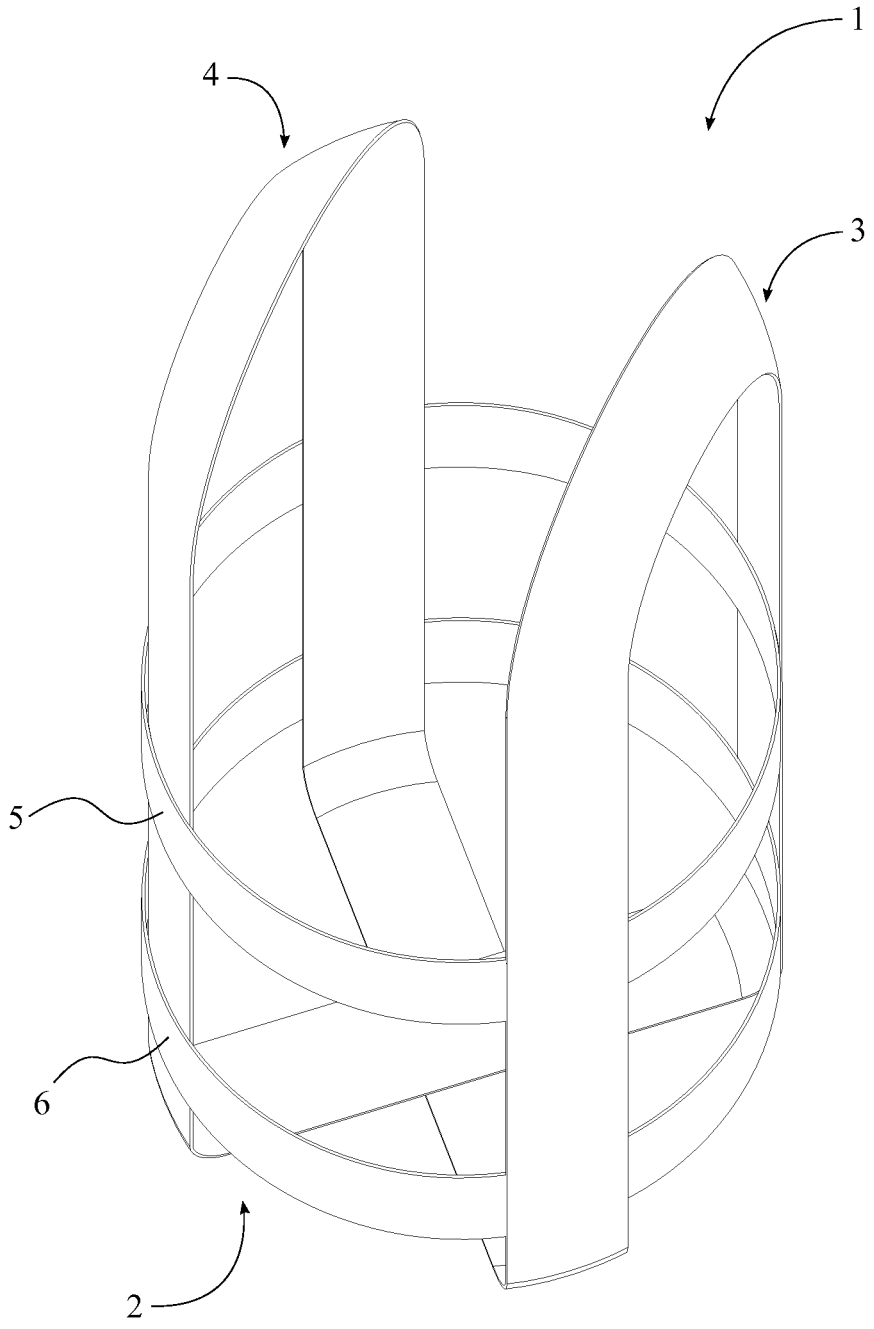
FIG. 1 is a top perspective view of the present invention.
Figure 2:
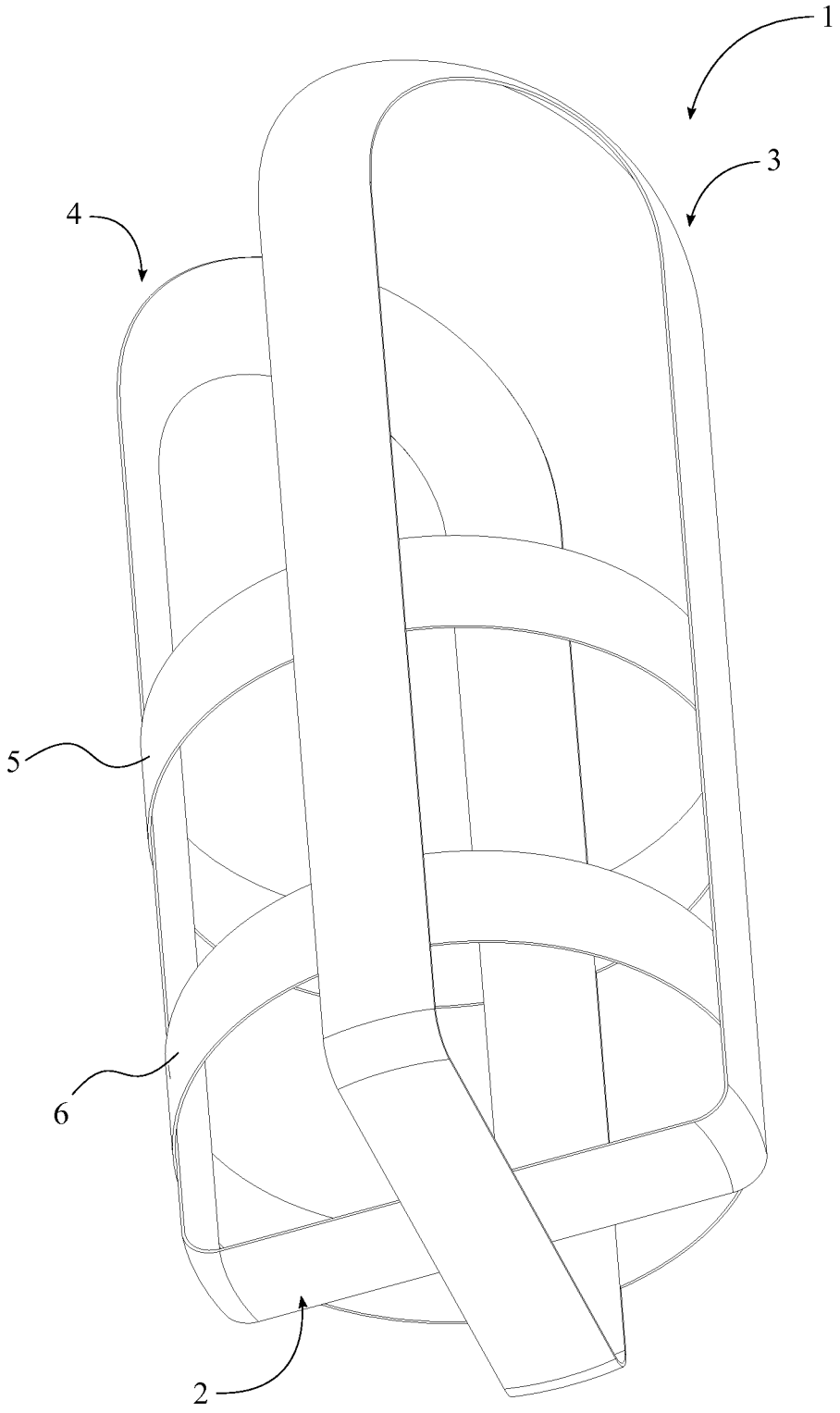
FIG. 2 is a bottom perspective view of the present invention.
Figure 3:
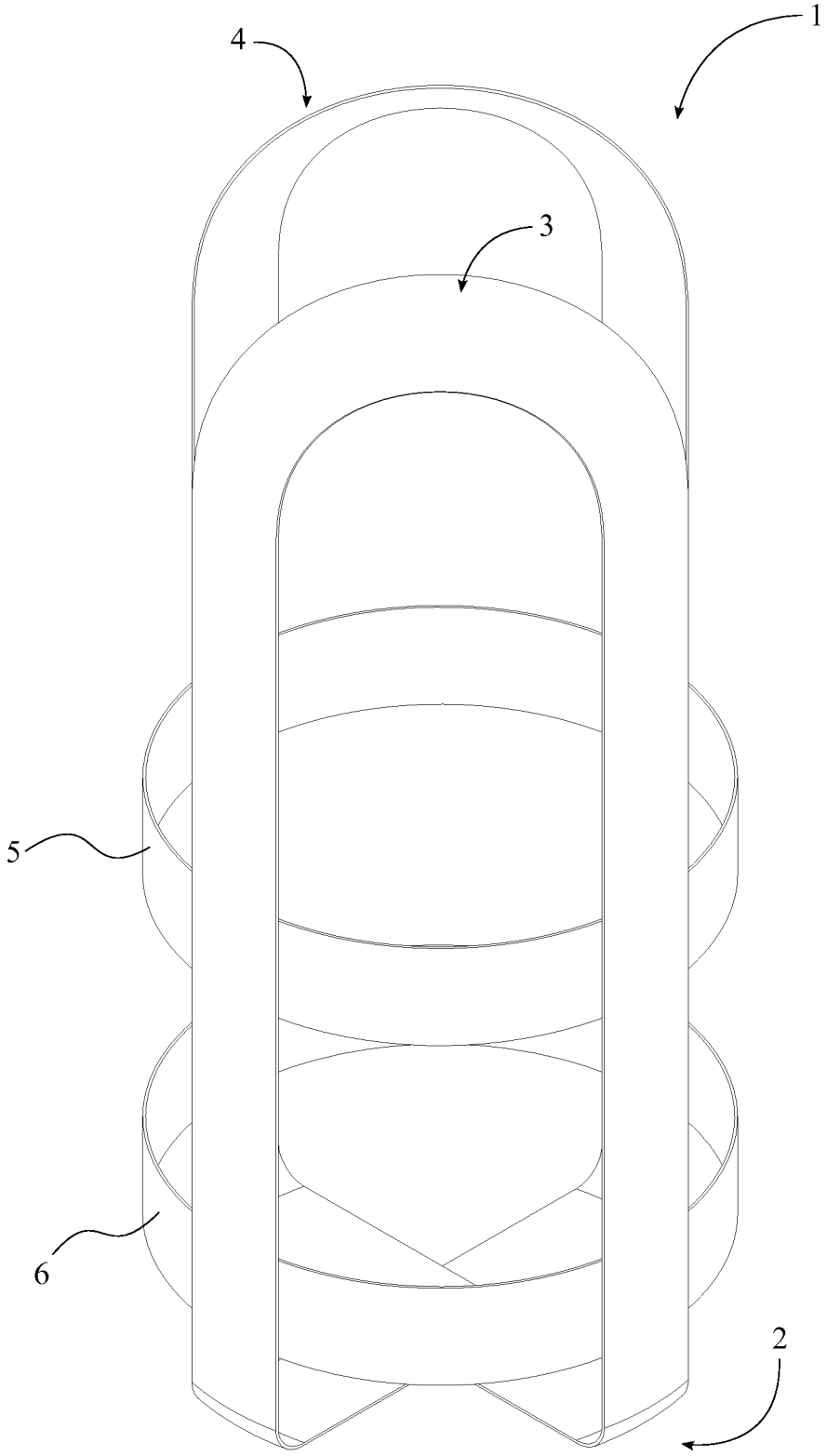
FIG. 3 is a perspective view of the present invention.

In reference to FIG. 1-3, the present invention is a water bottle strap carrier that a five gallon carboy type water bottle or any other appropriately shaped object may fit into. The preferred object utilized within the present invention is the five gallon carboy bottle, where the five gallon carboy bottle comprises a straight cylindrical side walled container so that drinking water or any other type liquid can be contained within. The invention itself comes in different colors and may be made from any type of material that can withstand high tensile strength, such as ultraviolet light resistant heavyweight polypropylene that has water resistance webbing. All of the connection points of the present invention are preferably connected through sewing, where T92 bounded polyester thread is used as the sewing thread. The present invention uses the material to form a basket like structure with attached handles to assist in the carrying of the five gallon carboy bottle, where the present invention allows the users to easily and securely carry a heavy bottle. The users may then use the handles to grip and pickup both the invention and the stored five gallon carboy bottle. The present invention comprises a longitudinal strap 1, an upper latitudinal strap 5, and a lower latitudinal strap 6, where the longitudinal strap 1 mainly restricts vertical movement of the five gallon carboy bottle while the upper latitudinal strap 5 and the lower latitudinal strap 6 mainly restricts the horizontal movement of the five gallon carboy bottle. The longitudinal strap 1 is preferably one hundred twenty seven inches in length, and both the upper latitudinal strap 5 and the lower latitudinal strap 6 are preferably thirty-eight and a half inches in length, where the longitudinal strap 1, the upper latitudinal strap 5, and the lower latitudinal strap 6 are two inches wide and six hundredths of an inch thick.

In reference to FIG. 1 and FIG. 2, the longitudinal strap 1 comprises a base section 2, a first strap section 3, and a second strap section 4. The base section 2, which generally supports the bottom side of the five gallon carboy bottle, is connected with the first strap section 3 and the second strap section 4 as the first strap section 3 and the second strap section 4 generally support the lateral wall of the five gallon carboy bottle. As the longitudinal strap 1 is vertically wrapped around the five gallon carboy bottle, the longitudinal strap 1 forms four separate arms. The four arms seem to be separate straps from one another, but they are formed through the single longitudinal strap 1.

Figure 4:
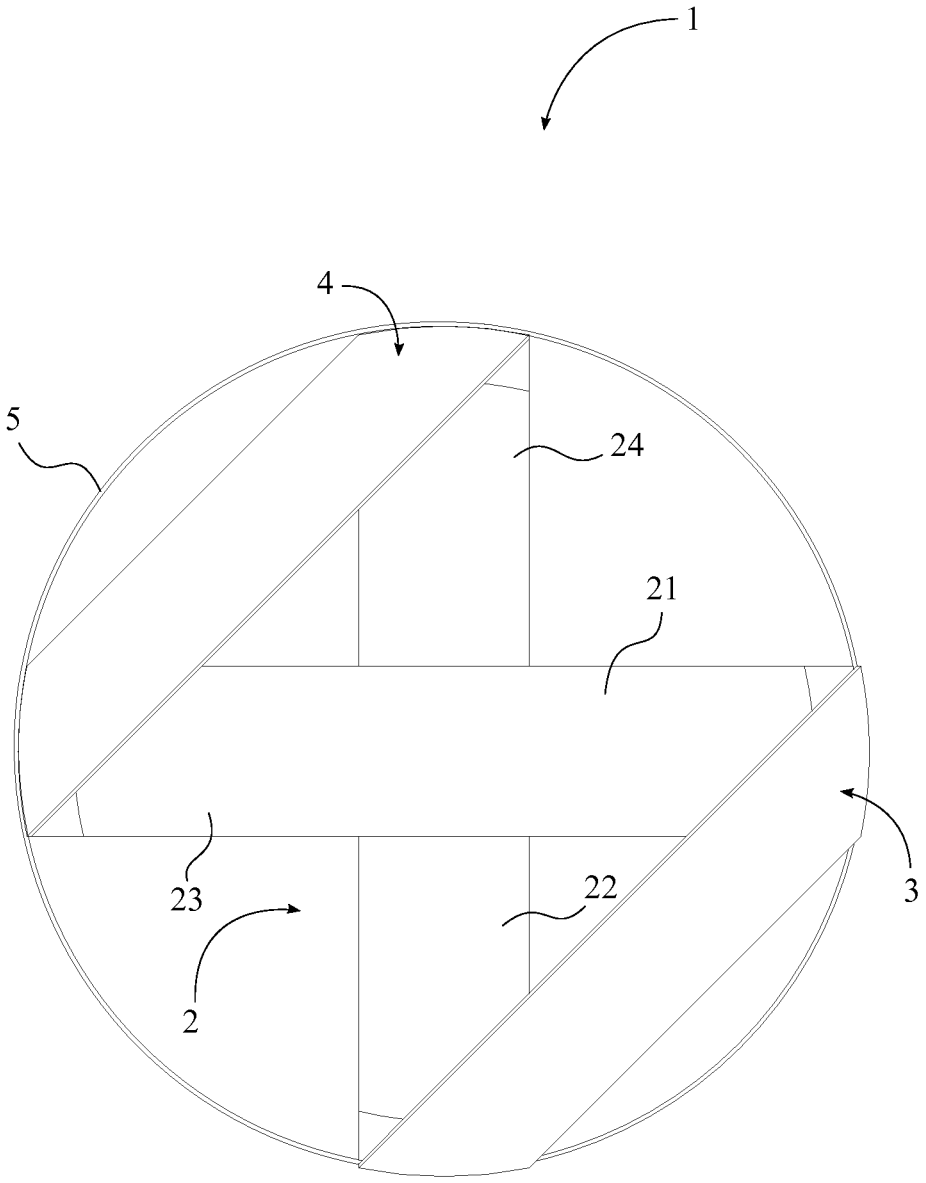
FIG. 4 is a top view of the present invention.
Figure 5:
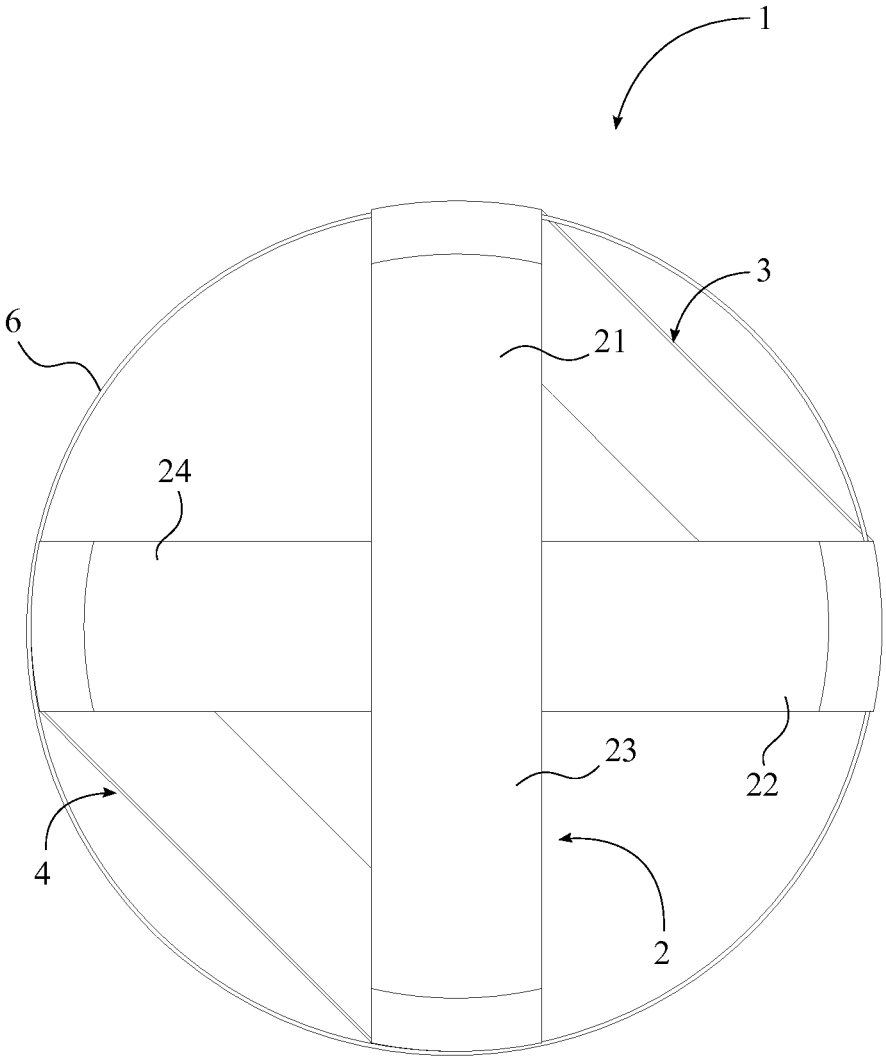
FIG. 5 is a bottom view of the present invention.
Figure 6:
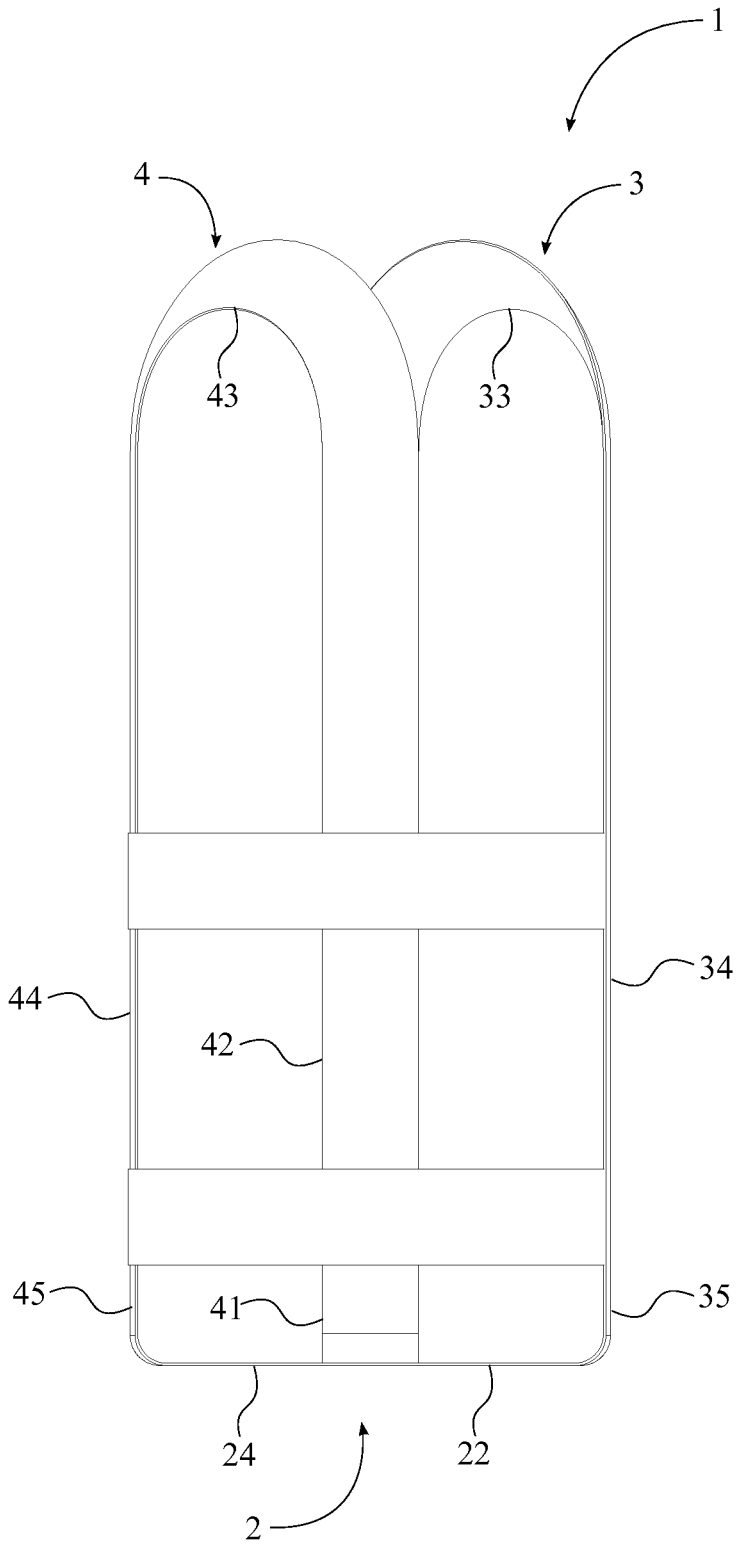
FIG. 6 is a front side view of the present invention, showing the second and fourth end portions.
Figure 7:
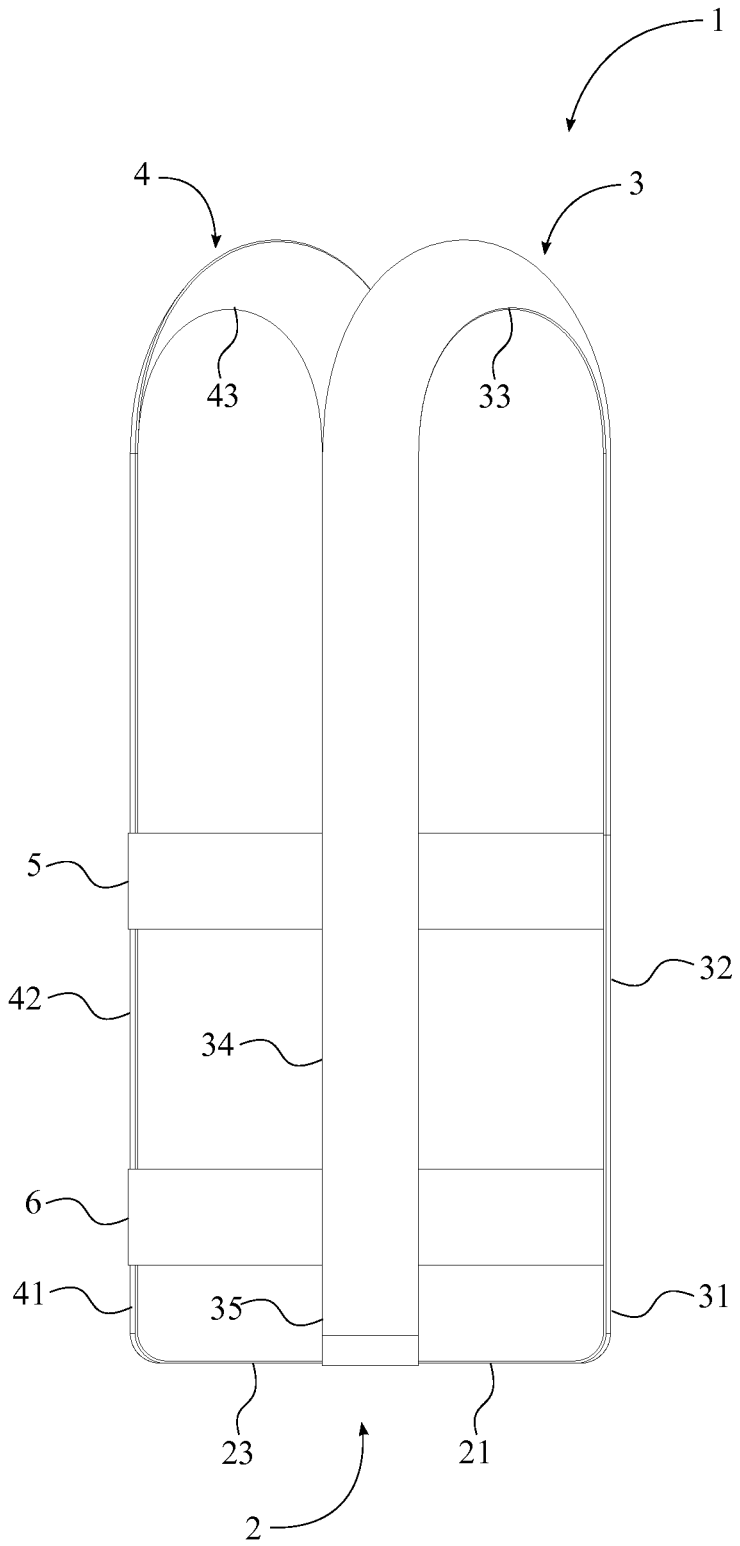
FIG. 7 is a front side view of the present invention, showing the third and first end portions.
Figure 8:
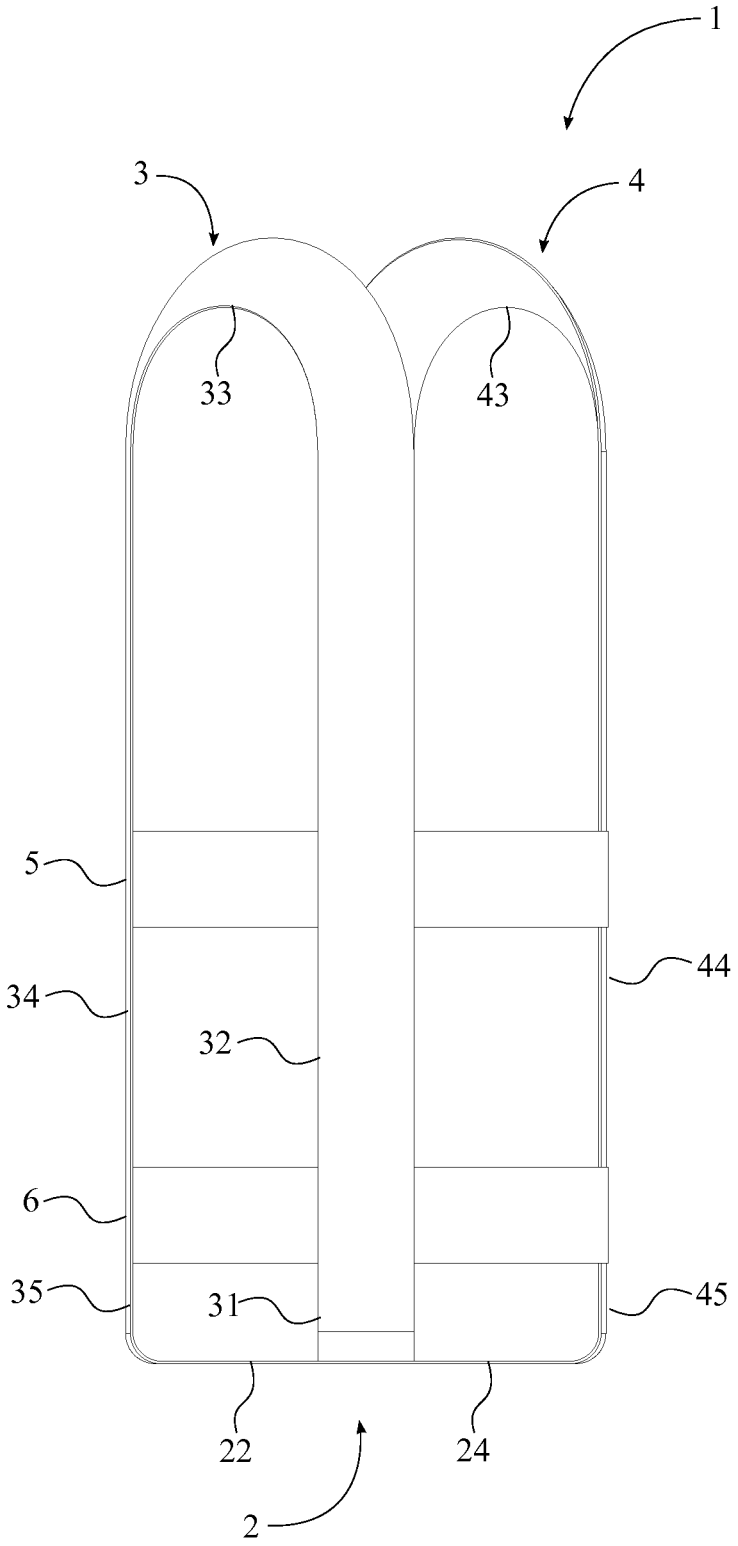
FIG. 8 is a rear side view of the present invention, showing the second and fourth end portions.

In reference to FIG. 4 and FIG. 5, the base section 2 comprises a first bottom strap 21, a second bottom strap 22, a third bottom strap 23, and a fourth bottom strap 24. The first bottom strap 21 and the second bottom strap 22 are linearly connected with each other, and the second bottom strap 22 and the fourth bottom strap 24 are also linearly connected with each other in such way that the first bottom strap 21 and the third bottom strap 23 are perpendicularly positioned with the second bottom strap 22 and the fourth bottom strap 24.

In reference to FIG. 6-FIG. 9, the first strap section 3 that is connected with the base section 2 comprises a first end portion 31, a first central portion 32, a first handle 33, a second central portion 34, and a second end portion 35. Similar to the first strap section 3, the second strap section 4 is also connected with the base section 2 and comprises a third end portion 41, a third central portion 42, a second handle 43, a fourth central portion 44, and a fourth end portion 45.

In reference to FIG. 6-FIG. 9, the first strap section 3, the first end portion 31 is adjacently connected with the first bottom strap 21, and the first central portion 32 is adjacently connected with the first end portion 31 opposite of the first bottom strap 21. The second end portion 35 is adjacently connected with the second bottom strap 22, and the second central portion 34 is adjacently connected with the second end portion 35 opposite of the second bottom strap 22. The first handle 33 is adjacently connected with the first central portion 32 and the second central portion 34 in such a way that the first handle 33 is positioned in between the first central portion 32 and the second central portion 34.

In reference to FIG. 6-FIG. 9, the second strap section 4, the third end portion 41 is adjacently connected with the third bottom strap 23, and the third central portion 42 is adjacently connected with the third end portion 41 opposite of the third bottom strap 23. The fourth end portion 45 is adjacently connected with the fourth bottom strap 24, and the fourth central portion 44 is adjacently connected with the fourth end portion 45 opposite of the fourth bottom strap 24. The second handle 43 is adjacently connected with the third central portion 42 and the fourth central portion 44 in such way that the second handle 43 is positioned in between the third central portion 42 and the fourth central portion 44.

In reference to FIG. 1 and FIG. 2, the first handle 33 and the second handle 43 of the present invention stick out above the central portions. The first handle 33 and the second handle 43 provide gripping areas so that the user may lift or carry the present invention. More specifically, the first handle 33 is formed from the longitudinal strap 1 running above the first central portion 32, curving downward in midair, and then running back down the second central portion 34. The second handle 43 is formed form the longitudinal strap 1 running above the third central portion 42, curving downward in midair, and then running back down the fourth central portion 44. The gripping areas that are faced away from each other are made out of the longitudinal strap 1 as the longitudinal strap 1 is folded, sewn, and stitched toward the outside.

Figure 9:
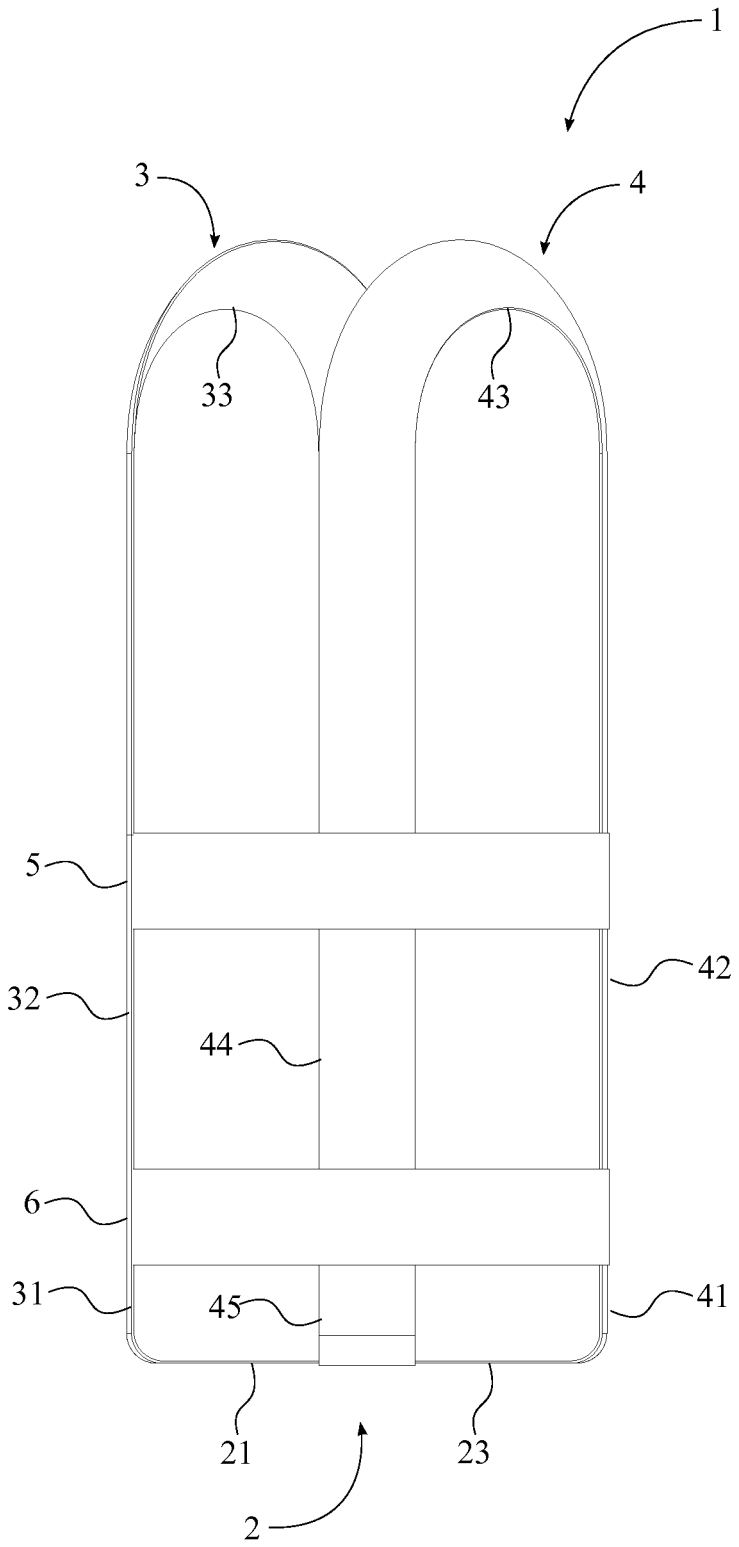
FIG. 9 is a rear side view of the present invention, showing the third and first end portions.

In reference to FIG. 9, the lower latitudinal strap 6 is perpendicularly connected with the first strap section 3 and the second strap section 4, where the lower latitudinal strap 6 is adjacently positioned with the base section 2. More specifically, the lower latitudinal strap 6 is connected with the first central portion 32, the second central portion 34, the third central portion 42, and the fourth central portion 44, where the lower latitudinal strap 6 is adjacently positioned with the first end portion 31, the second end portion 35, the third end portion 41, and the fourth end portion 45. Since the lower latitudinal strap 6 is positioned in conjunction with the first strap section 3 and the second strap section 4, the lower latitudinal strap 6 restricts the horizontal movement of the five gallon carboy bottle from the bottom end.

In reference to FIG. 9, the upper latitudinal strap 5 is perpendicularly connected with the first strap section 3 and the second strap section 4, where the upper latitudinal strap 5 is adjacently positioned with the lower latitudinal strap 6 opposite of the base section 2. More specifically, the upper latitudinal strap 5 is connected with the first central portion 32, the second central portion 34, the third central portion 42, and the fourth central portion 44, where the upper latitudinal strap 5 is adjacently positioned with the first handle 33 and the second handle 43. Since the upper latitudinal strap 5 is positioned in conjunction with the first strap section 3 and the second strap section 4, the upper latitudinal strap 5 restricts the horizontal movement of the five gallon carboy bottle from the top end.

Figure 10:
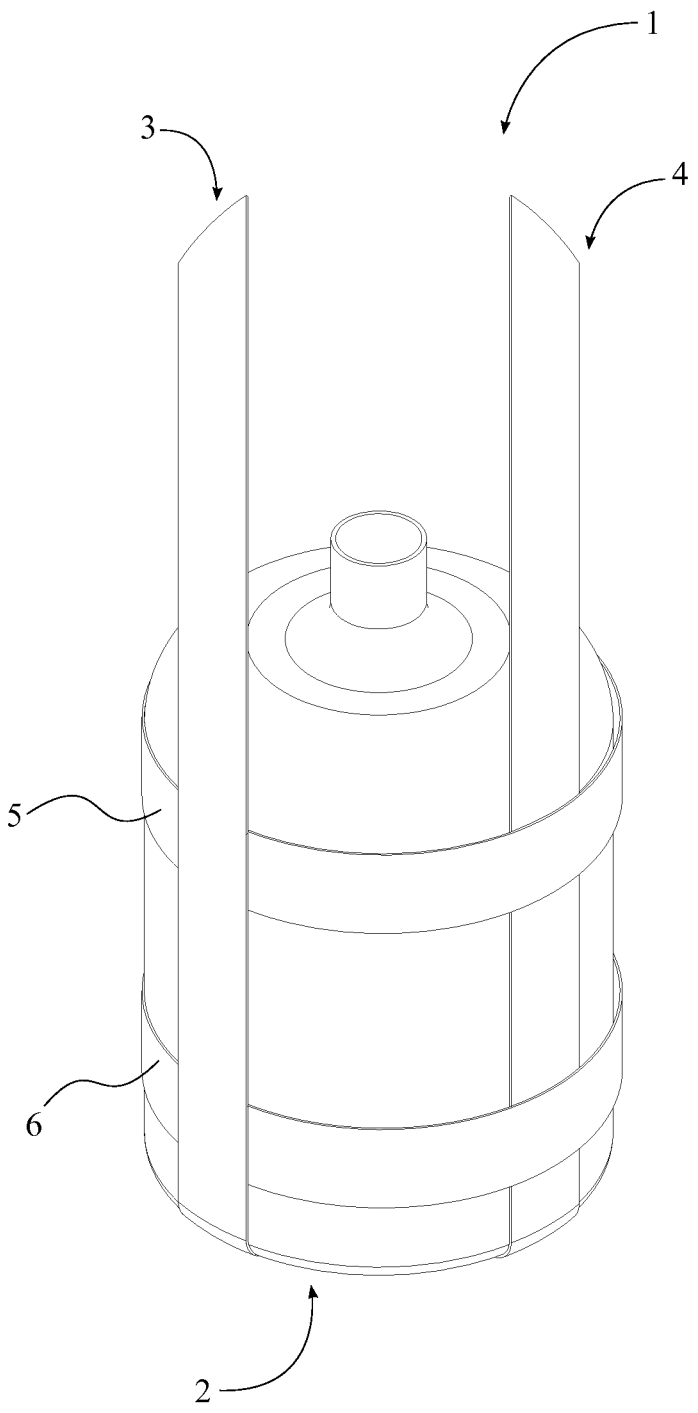
FIG. 10 is a perspective view of the present invention, showing the five gallon carboy bottle.

In the preferred embodiment of the present invention, the base section 2 is a cross-shaped area forming the bottom of the water bottle strap carrier. The middle of the cross-shaped area is a patched area, where the first bottom strap 21, the second bottom strap 22, the third bottom strap 23, and the fourth bottom strap 24 of the longitudinal strap 1 are overlapped and stitched together as shown in FIG. 10. The first bottom strap 21, the second bottom strap 22, the third bottom strap 23, and the fourth bottom strap 24 are approximately four inches in length from the overlapped section of the base section 2. The first handle 33 and the second handle 43 are distanced seventeen and a half inches from each other, and the gripping areas that are positioned on the apex of first handle 33 and the second handle 43 have a one-inch wide by four inches long parameter section.

The top of the lower latitudinal strap 6 is positioned two inches from the base section 2 while the top of the upper latitudinal strap 5 is positioned eleven inches from the base section 2. As result of the positioning of the upper latitudinal strap 5 and the lower latitudinal strap 6, five inch spacing is utilized in between the lower latitudinal strap 6 and the upper latitudinal strap 5. Overall the upper latitudinal strap 5 and the lower latitudinal strap 6 are stitched with the longitudinal strap 1 within eight intersection points within the preferred embodiment. At four of the intersection points there is a half inch wide strap extension with a triple strap layover, where the latitudinal strap is stitched on top of the longitudinal strap 1. These four intersection points are positioned either with the first central portion 32 and the second central portion 34 that make up the first handle 33 or the third central portion 42 and the fourth central portion 44 that make up the second handle 43. The other four intersection points have a double strap overlay stitching, and are positioned opposite of the strap extensions. At the double strap overlay, the latitudinal strap is stitched under the longitudinal strap 1. More specifically, if the strap extensions are positioned with the first central portion 32 and the second central portion 34 that make up the first handle 33, the double strap overlay is positioned with the third central portion 42 and the fourth central portion 44 that make up the second handle 43. If the strap extensions are positioned with the third central portion 42 and the fourth central portion 44 that make up the second handle 43, the double strap overlay is positioned with the first central portion 32 and the second central portion 34 that make up the first handle 33. The overlaying stitching is a very unique aspect of this present invention as it allows for a much safer design for the preferred embodiment. Additionally, the preferred embodiment comprises a tensile strength (breaking point) range of six hundred seventy five pounds, up to eighteen hundred pounds, and a melting point of three hundred thirty degrees Fahrenheit. The previously mentioned dimensions and parameters are for the preferred embodiment, where the dimensions and parameters may take on entirely different values without comprising the spirit of the present invention.

Figure 11:
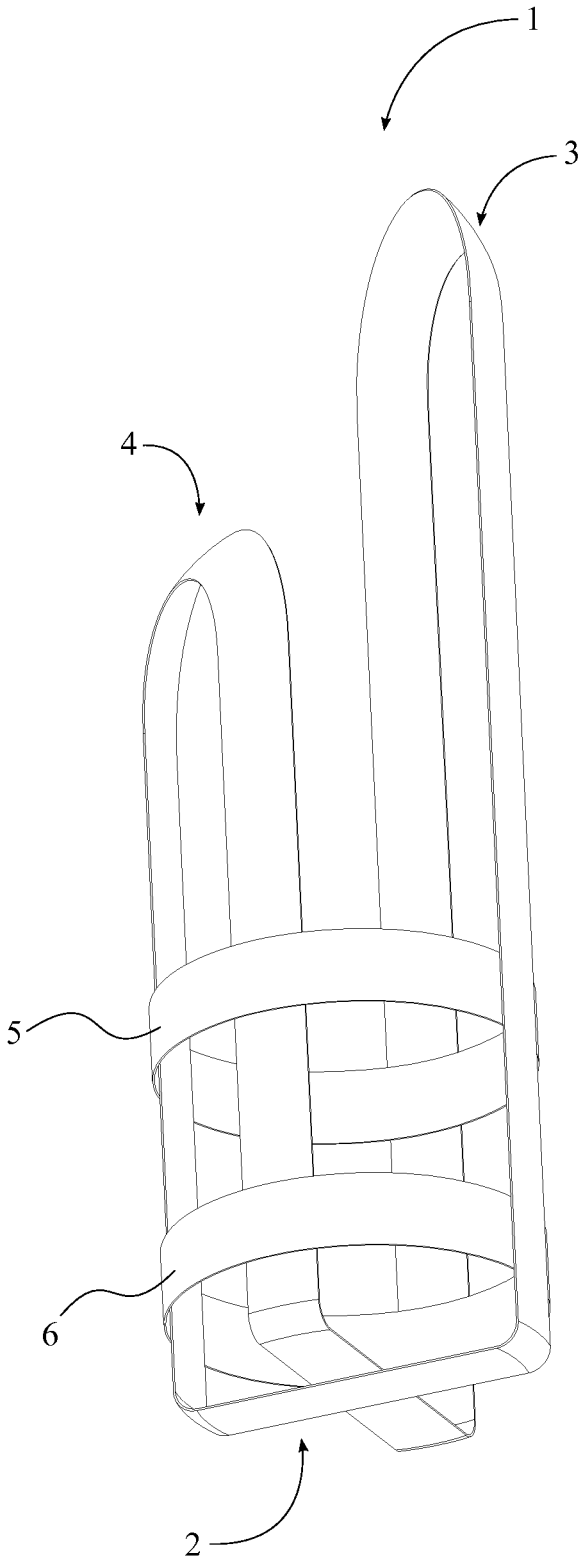
FIG. 11 is an alternative embodiment of the present invention.

FIG. 11 shows an alternative embodiment of the present invention. The alternative embodiment is similar to the preferred embodiment but the second strap section 4 is shorter than the first strap section 3. Since the first strap section 3 is longer than the second strap section 4, the first strap section 3 can be inserted through the second strap section 4 in order to secure the water bottle strap carrier within the alternative embodiment.

The present invention can be used for many different purposes. The user can utilize the present invention to easily lift and carry the five gallon carboy bottle. The present invention also allows the user easily place the five gallon carboy bottle on the water dispenser. More specifically, the users can lift the five gallon carboy bottle through the present invention using only one hand while the other hand is used to flip the five gallon carboy bottle in order to properly place the five gallon carboy bottle on the water dispenser. The five gallon carboy bottle can be suspended upside down from a pole or a post by the usage of the present invention. For example, the first handle 33 and the second handle 43 are crossed over each other above the opening of the five gallon carboy bottle so that the five gallon carboy bottle is secured within the present invention as the five gallon carboy bottle comes down the present invention and the bottle neck area locks the five gallon carboy bottle within the first handle 33 and the second handle 43.

Although the invention has been explained in relation to its preferred embodiment, it is to be understood that many other possible modifications and variations can be made without departing from the spirit and scope of the invention as hereinafter claimed. All dimensions, manufacturing methods, and materials mentioned were for the preferred embodiment and they may take different adaptations without losing the spirit of the invention. All carrying methods and items to be carried are solely suggestions and are not being made to limit the scope of the invention in anyway.

What is claimed is:

1. A water bottle strap carrier comprises:
a longitudinal strap;
an upper latitudinal strap;
a lower latitudinal strap;
the longitudinal strap comprises a base section, a first strap section, and a second strap section;
the base section comprises a first bottom strap, a second bottom strap, a third bottom strap, and a fourth bottom strap;
the first strap section comprises a first end portion, a first central portion, a first handle, a second central portion, and a second end portion;
the second strap section comprises a third end portion, a third central portion, a second handle, a fourth central portion, and a fourth end portion;
the base section being connected with the first strap section and the second strap section;
the lower latitudinal strap being perpendicularly connected with the first strap section and the second strap section; and
the upper latitudinal strap being perpendicularly connected with the first strap section and the second strap section.

2. The water bottle strap carrier as claimed in claim 1 comprises:
the lower latitudinal strap being positioned adjacent to the base section; and
the upper latitudinal strap being adjacently positioned with the lower latitudinal strap opposite of the base section.

3. The water bottle strap carrier as claimed in claim 1 comprises:
the first bottom strap, the second bottom strap, the third bottom strap, and the fourth bottom strap being connected to each other;
the first bottom strap and the third bottom strap being linearly connected with each other;
the second bottom strap and the fourth bottom strap being linearly connected with each other; and
the first bottom strap and the third bottom strap being perpendicularly positioned with the second bottom strap and the fourth bottom strap.

4. The water bottle strap carrier as claimed in claim 1 comprises:
the first end portion being adjacently connected with the first bottom strap;
the first central portion being adjacently connected with the first end portion opposite of the first bottom strap;
the second end portion being adjacently connected with the second bottom strap;
the second central portion being adjacently connected with the second end portion opposite of the second bottom strap;
the first handle being adjacently connected with the first central portion and the second central portion; and
the first handle being positioned in between the first central portion and the second central portion.

5. The water bottle strap carrier as claimed in claim 1 comprises:
the third end portion being adjacently connected with the third bottom strap;
the third central portion being adjacently connected with the third end portion opposite the third bottom strap;
the fourth end portion being adjacently connected with the fourth bottom strap;
the fourth central portion being adjacently connected with the fourth end portion opposite the fourth bottom strap;
the second handle being adjacently connected with the third central portion and the fourth central portion; and
the second handle being positioned in between the third central portion and the fourth central portion.

6. The water bottle strap carrier as claimed in claim 1 comprises:
the lower latitudinal strap being connected with the first central portion, the second central portion, the third central portion, and the fourth central portion; and
the lower latitudinal strap being adjacently positioned with the first end portion, the second end portion, the third end portion, and the fourth end portion.

7. The water bottle strap carrier as claimed in claim 1 comprises:
the upper latitudinal strap being connected with the first central portion, the second central portion, the third central portion, and the fourth central portion; and
the upper latitudinal strap being adjacently positioned with the first handle and the second handle.

8. A water bottle strap carrier comprises:
a longitudinal strap;
an upper latitudinal strap;
a lower latitudinal strap;
the longitudinal strap comprises a base section, a first strap section, and a second strap section;
the base section comprises a first bottom strap, a second bottom strap, a third bottom strap, and a fourth bottom strap;

the first strap section comprises a first end portion, a first central portion, a first handle, a second central portion, and a second end portion;

the second strap section comprises a third end portion, a third central portion, a second handle, a fourth central portion, and a fourth end portion;

the base section being connected with the first strap section and the second strap section;

the lower latitudinal strap being perpendicularly connected with the first strap section and the second strap section;

the lower latitudinal strap being positioned adjacent to the base section;

the upper latitudinal strap being perpendicularly connected with the first strap section and the second strap section; and the upper latitudinal strap being adjacently positioned with the lower latitudinal strap opposite of the base section.

9. The water bottle strap carrier as claimed in claim 8 comprises:

the first bottom strap, the second bottom strap, the third bottom strap, and the fourth bottom strap being connected to each other;

the first bottom strap and the third bottom strap being linearly connected with each other;

the second bottom strap and the fourth bottom strap being linearly connected with each other; and the first bottom strap and the third bottom strap being perpendicularly positioned with the second bottom strap and the fourth bottom strap.

10. The water bottle strap carrier as claimed in claim 8 comprises:

the first end portion being adjacently connected with the first bottom strap;

the first central portion being adjacently connected with the first end portion opposite of the first bottom strap;

the second end portion being adjacently connected with the second bottom strap;

the second central portion being adjacently connected with the second end portion opposite of the second bottom strap;

the first handle being adjacently connected with the first central portion and the second central portion; and the first handle being positioned in between the first central portion and the second central portion.

11. The water bottle strap carrier as claimed in claim 8 comprises:

the third end portion being adjacently connected with the third bottom strap;

the third central portion being adjacently connected with the third end portion opposite the third bottom strap;

the fourth end portion being adjacently connected with the fourth bottom strap;

the fourth central portion being adjacently connected with the fourth end portion opposite the fourth bottom strap;

the second handle being adjacently connected with the third central portion and the fourth central portion; and the second handle being positioned in between the third central portion and the fourth central portion.

12. The water bottle strap carrier as claimed in claim 8 comprises:

the lower latitudinal strap being connected with the first central portion, the second central portion, the third central portion, and the fourth central portion; and the lower latitudinal strap being adjacently positioned with the first end portion, the second end portion, the third end portion, and the fourth end portion.

13. The water bottle strap carrier as claimed in claim 8 comprises:

the upper latitudinal strap being connected with the first central portion, the second central portion, the third central portion, and the fourth central portion; and the upper latitudinal strap being adjacently positioned with the first handle and the second handle.

14. A water bottle strap carrier comprises:

a longitudinal strap;

an upper latitudinal strap;

a lower latitudinal strap;

the longitudinal strap comprises a base section, a first strap section, and a second strap section;

the base section comprises a first bottom strap, a second bottom strap, a third bottom strap, and a fourth bottom strap;

the first strap section comprises a first end portion, a first central portion, a first handle, a second central portion, and a second end portion;

the second strap section comprises a third end portion, a third central portion, a second handle, a fourth central portion, and a fourth end portion;

the first bottom strap, the second bottom strap, the third bottom strap, and the fourth bottom strap being connected to each other;

the first bottom strap and the third bottom strap being linearly connected with each other;

the second bottom strap and the fourth bottom strap being linearly connected with each other;

the first bottom strap and the third bottom strap being perpendicularly positioned with the second bottom strap and the fourth bottom strap;

the base section being connected with the first strap section and the second strap section;

the lower latitudinal strap being perpendicularly connected with the first strap section and the second strap section;

the lower latitudinal strap being positioned adjacent to the base section;

the upper latitudinal strap being perpendicularly connected with the first strap section and the second strap section; and the upper latitudinal strap being adjacently positioned with the lower latitudinal strap opposite of the base section.

15. The water bottle strap carrier as claimed in claim 14 comprises:

the first end portion being adjacently connected with the first bottom strap;

the first central portion being adjacently connected with the first end portion opposite of the first bottom strap;

the second end portion being adjacently connected with the second bottom strap;

the second central portion being adjacently connected with the second end portion opposite of the second bottom strap;

the first handle being adjacently connected with the first central portion and the second central portion; and the first handle being positioned in between the first central portion and the second central portion.

16. The water bottle strap carrier as claimed in claim 14 comprises:

the third end portion being adjacently connected with the third bottom strap;

the third central portion being adjacently connected with the third end portion opposite the third bottom strap;

the fourth end portion being adjacently connected with the fourth bottom strap;

the fourth central portion being adjacently connected with the fourth end portion opposite the fourth bottom strap;

the second handle being adjacently connected with the third central portion and the fourth central portion; and the second handle being positioned in between the third central portion and the fourth central portion.

17. The water bottle strap carrier as claimed in claim 14 comprises:

the lower latitudinal strap being connected with the first central portion, the second central portion, the third central portion, and the fourth central portion; and the lower latitudinal strap being adjacently positioned with the first end portion, the second end portion, the third end portion, and the fourth end portion.

18. The water bottle strap carrier as claimed in claim 14 comprises:

the upper latitudinal strap being connected with the first central portion, the second central portion, the third central portion, and the fourth central portion; and the upper latitudinal strap being adjacently positioned with the first handle and the second handle.

* * * * *